US005843298A

United States Patent [19]

Orac et al.

[11] Patent Number: 5,843,298

[45] Date of Patent: Dec. 1, 1998

[54] METHOD OF PRODUCTION OF SOLIDS-FREE COAL TAR PITCH

[75] Inventors: Thomas Harry Orac; Ching F. Chang; Irwin C. Lewis, all of Strongsville; Richard L. Shao, North Royalton, all of Ohio

[73] Assignee: UCAR Carbon Technology Corporation, Danbury, Conn.

[21] Appl. No.: 722,469

[22] Filed: Sep. 27, 1996

[51] Int. Cl.[6] ..... C10C 1/04

[52] U.S. Cl. ..... 208/42; 208/22; 208/23

[58] Field of Search ..... 208/22, 23, 42

[56] References Cited

U.S. PATENT DOCUMENTS

| | | | |
|---|---|---|---|
| 2,956,944 | 10/1960 | Logan et al. | 208/39 |
| 3,173,851 | 3/1965 | King et al. | 208/23 |
| 4,127,472 | 11/1978 | Migitaka et al. | 208/87 |
| 4,177,132 | 12/1979 | Uemura et al. | 208/22 |
| 4,183,802 | 1/1980 | Romey | 208/88 |
| 4,259,171 | 3/1981 | Stadelhofer et al. | 208/45 |
| 4,333,816 | 6/1982 | Kolling et al. | 208/91 |
| 4,436,615 | 3/1984 | Boodman et al. | 208/177 |
| 4,604,184 | 8/1986 | Cukier et al. | 208/22 |
| 4,954,240 | 9/1990 | Eidt, Jr. et al. | 208/50 |
| 5,534,133 | 7/1996 | Lewis et al. | 208/39 |

OTHER PUBLICATIONS

K. Kai 3(1991) 166,290–Toho Gas, "Method for the Purification of Coal Tar and Coal Tar Pitch", Jul.

H.A. Kremer, Chemistry and Industry, pp. 702–713, Sep. 18, 1982, "Recent Developments in Electorde Pitch and Coal Tar Technology".

*Primary Examiner*—Walter D. Griffin
*Assistant Examiner*—Nadine Preisch
*Attorney, Agent, or Firm*—Frederick J. McCarthy

[57] ABSTRACT

A process for converting coal tar containing quinoline-insoluble particles (Q.I.) produces a substantially Q.I.-free coal tar pitch and a separate, Q.I.-containing coal tar pitch. Dehydrated coal tar, soft coal tar pitch or hard coal tar pitch are subjected to continuous cross flow filtration in a circulation loop to obtain a substantially Q.I.-free stream and, concurrently, a Q.I.-containing stream. The two streams are then separately subjected to further fractionation, if any, to produce the substantially Q.I.-free hard coal tar pitch and separate Q.I.-containing hard coal tar pitch.

35 Claims, 9 Drawing Sheets

METHOD OF PRODUCTION OF SOLIDS-FREE COAL TAR PITCH

BACKGROUND OF THE INVENTION

1. Field of the Invention

The present invention relates to a continuous method for distilling coal tar containing Q.I. solids to provide coal-tar pitch having increased Q.I. concentration and, concurrently, a Q.I. free coal-tar pitch.

2. Description of Related Art

Production of graphite electrodes for the steel industry requires two kinds of pitches: binder pitch and impregnating pitch. Binder pitch is used to form the electrodes from coke particles. Impregnating pitch is used to fill the pores in the formed and carbonized electrodes. Pitches are the residues of coal tar distillation. Coal tars contain solid carbon particles, which end up in the pitch.

In the preparation of carbon artifacts such as graphite electrodes, a carbonaceous filler such as petroleum coke is admixed with a coal tar pitch binder and then formed, carbonized, and graphitized to produce a graphite product. For maximum product strength, it is important that the coal tar pitch binder gives a good yield of carbon after carbonization. The presence of relatively high amounts of infusible carbon solids i.e., fine particles, generally called "Q.I." (quinoline insoluble), is desirable for an effective binder in order to increase coking yield and to provide a source of fine carbon particles which also improve graphite artifact strength. Commercial coal tar binder pitches usually contain between 6–20% by weight Q.I. in the form of small (micron) size particles. These particles are generated during the production of coal tar in coking ovens.

Very often, in order to increase strength, the carbon artifact is impregnated with pitch after carbonization. The pitch impregnant fills the pores generated during the initial carbonization of the carbon article and increases final graphite product strength and density. Impregnating pitches are preferred free of infusible solids (Q.I.), so they can easily penetrate into the pores of the carbonized electrode. The presence of these fine solid particles would block the accessible pores of the carbon article and prevent full impregnation of the pitch into the artifact.

Solid particles can be removed by filtration either from the pitch itself or from the coal tar before distillation, but there are also advantages in filtering an intermediate stream in the tar distillation process.

Tar distillation plants typically consist of a tar dehydration tower and one or more tar fractionation towers. Crude tar is pumped from tankage at about 65° C. through a preheat train to the dehydration tower, which operates at about 160° C. and removes water and light oil from the crude tar. The dehydrated tar continues into the fractionation tower(s), where it is processed into pitch and various distillates.

A cross-flow filtration process, such as microfiltration and ultrafiltration, has been in commercial use for several decades producing simultaneously and continuously a solids-free liquid and a solids-enriched liquid, without producing a filter cake. The cross-flow filtration process has recently been adapted for filtering crude coal tar as disclosed in U.S. Pat. No. 5,534,133 (assigned to the assignee of this application), the disclosure of which is hereby incorporated by reference. However, this cross-flow filtration process was disclosed only as a stand-alone process. Likewise, stand-alone batch processes have been developed for removal of Q.I. from coal tars to produce solids-free impregnating pitches as disclosed in U.S. Pat. No. 4,127,472 which involve treatment of the tar with an anti-solvent to settle the Q.I., followed by separation of the Q.I. by filtration or centrifugation. The separated Q.I. is a waste material which must then be disposed. Japan published patent application 1(1989)-305,640 also discloses the use of membrane filters to remove Q.I. solids from coal tar and coal tar pitch in a batch type procedure.

There is presently no known process for continuously providing coal-tar pitch having an increased Q.I. concentration and, concurrently, a Q.I.-free coal-tar pitch from the coal tar distillation process itself. It would be very advantageous to have a continuous coal tar distillation process which could produce, at the same time, essentially zero percent Q.I. pitches for use as impregnants, and high Q.I. pitches in the range of 8–20% by weight for use as binders.

Bearing in mind the problems and deficiencies of the prior art, it is therefore an object of the present invention to provide a process for converting coal tar to a finished pitch product which would have a Q.I. content greater than that which could be achieved by commercial direct distillation of the coal tar.

It is another object of the present invention to provide a process for converting coal-tar, containing quinoline-insoluble solids (Q.I.), to a finished pitch product which would have a Q.I. content greater than that which could be achieved by commercial distillation while simultaneously producing a substantially Q.I.-free coal-tar pitch.

Still other objects and advantages of the invention will in part be obvious and will in part be apparent from the specification.

SUMMARY OF THE INVENTION

The above and other objects and advantages, which will be apparent to those skilled in the art, are achieved in the present invention which is directed to, in a first aspect a process for converting coal tar, containing quinoline-insoluble particles (Q.I.), to produce coal tar pitch. The process comprises initially heating Q.I.-containing coal tar to a temperature sufficient to remove therefrom substantially all water to produce a heated dehydrated tar. The heated dehydrated tar is continuously fed into a circulation loop which includes a cross-flow filtration membrane filter and a pump to circulate continuously the heated dehydrated tar to obtain (i) a substantially Q.I.-free permeate stream exiting the circulation loop via the cross-flow filter and (ii) a Q.I.-containing stream. Thereafter, and concurrently with the feeding of additional heated dehydrated tar into the circulation loop, a portion of the Q.I.-containing stream is continuously released from the loop. Thereafter the process comprises separately fractionating the substantially Q.I.-free permeate stream and the Q.I.-containing stream to separate and remove tar distillate fractions and produce a substantially Q.I.-free coal tar pitch and a separate, Q.I.-containing coal tar pitch. Preferably, the dehydrated tar is maintained at or close to its processing temperature, which could be between about 140° C. and 180° C. as it is fed into the circulation loop, and at a pressure above about 40 psig as it is in the circulation loop, to obtain the substantially Q.I.-free permeate stream and the Q.I.-containing stream.

In another aspect, the present invention converts coal tar, containing quinoline-insoluble particles (Q.I.), by initially heating Q.I.-containing coal tar to a temperature sufficient to remove therefrom substantially all water to produce a heated dehydrated tar and then fractionating the dehydrated tar to separate and remove tar distillate fractions to produce a soft coal tar pitch. Thereafter, the soft coal tar pitch is continuously fed into a circulation loop which includes a cross-flow filtration membrane filter and a pump to circulate continuously the soft coal tar pitch to obtain (i) a substantially Q.I.-free permeate stream exiting the circulation loop via the cross-flow filter and (ii) a Q.I.-containing stream. Concurrently with the feeding of additional soft coal tar pitch into the circulation loop, a portion of the Q.I.-containing circulating stream is continuously released from the loop. The substantially Q.I.-free permeate stream and the Q.I.-containing stream are separately flashed to separate and remove the remaining additional tar distillate fraction and produce a substantially Q.I.-free coal tar pitch and a separate, Q.I.-containing coal tar pitch. Preferably, the soft coal tar pitch is maintained at or just below the temperature at which it is produced. It is fed into the circulation loop, e.g. above about 250° C., and at a pressure above about 40 psig as it is in the circulation loop, to obtain the substantially Q.I.-free permeate stream and the Q.I.-containing stream.

In yet another aspect, the present invention provides a process for converting coal tar containing quinoline-insoluble particles (Q.I.), which comprises initially heating the Q.I.-containing coal tar to a temperature sufficient to remove therefrom substantially all water to produce a heated dehydrated tar and then fractionating the dehydrated tar to separate and remove tar distillate fractions to produce a hard coal tar pitch. Thereafter, the hard coal tar pitch is continuously fed into a circulation loop which includes a cross-flow filtration membrane filter and a pump to circulate continuously the hard coal tar pitch to obtain (i) a substantially Q.I.-free permeate stream exiting the circulation loop via the cross-flow filter and (ii) a Q.I.-containing stream. Concurrently with the feeding of additional hard coal tar pitch into the circulation loop, a portion of the Q.I.-containing circulating stream is continuously released from the loop. Thereafter the substantially Q.I.-free permeate stream and the Q.I.-containing stream are separately cooled to produce a substantially Q.I.-free coal tar pitch and a separate, Q.I.-containing coal tar pitch. Preferably, the hard coal tar pitch is maintained at or just below the temperature at which it is produced, e.g., above about 300° C. which is fed into the circulation loop, and at a pressure above about 40 psig as it is in the circulation loop, to obtain the substantially Q.I.-free permeate stream and the Q.I.-containing stream.

In the process of the present invention, the coal tar products and intermediate streams are all preferably maintained at or just below the temperature at which they are produced and all of the steps may be continuous. Alternatively, at least some of the steps, other than the step of continuously circulating the dehydrated tar or pitch to obtain the substantially Q.I.-free permeate stream and the Q.I.-containing stream, are not continuous and may be performed in a batch process.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE INVENTION

Figure 1:
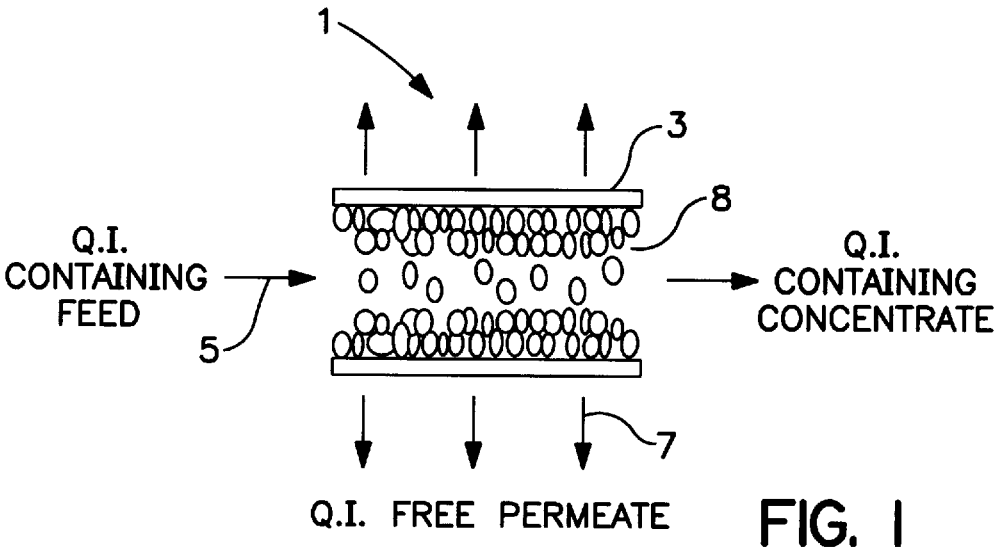
FIG. 1 is a schematic representation of a cross-flow ceramic membrane filter of the type employed in the present invention.

In describing the preferred embodiment of the present invention, reference will be made herein to FIGS. 1–10 of the drawings in which like numerals refer to like features of the invention. Features of the invention are not necessarily shown to scale in the drawings. Unless otherwise stated, all percentages referenced herein are by weight.

The present invention produces solids-free coal tar pitch by filtering either an internal stream in the tar distillation process at its processing temperature, or by filtering the final pitch at or close to its processing temperature. Filtration is faster than by filtering the tar or the pitch at their storage temperatures because operating temperatures are higher and viscosities are several times lower than product viscosities at storage temperatures. Cross-flow filtration as described in U.S. Pat. No. 5,534,133 is the preferred method of removing the solids. Cross-flow filtration produces simultaneously a solids-free liquid stream and a solids-enriched liquid stream without leaving a filter cake. The two streams fit the needs of the electrode manufacturing industry, which favors solids-rich binder pitches and solids-free impregnating pitches.

Crude coal tar is usually stored at about 65° C. and pitch is usually stored at 200° C. to 250° C. The viscosities of these liquids at their respective storage temperatures are about 50 centipoise (cps). The viscosity of dehydrated tar at its process temperature of about 160° C. is about 10 cps or lower. The viscosity of pitch at its production temperature of about 350° C. or higher is well below 10 cps (determined by extrapolation since viscosity is difficult to measure at this high temperature). Pitch is normally cooled before storage to about 250° C. or less. Its viscosity at 250° C. is about 10 to 20 cps. Viscosities of other intermediate streams in the tar distillation plant described below are also in the range of 10 cps or less.

The process of the present invention filters one of the intermediate streams in the tar distillation plant at its processing temperature or, alternatively, it filters the final pitch at or slightly below its processing temperature. In the preferred embodiment, dehydrated tar is filtered at approximately 160° C. Standard equipment now commercially available is capable of operation at up to about 320° C. As equipment suitable for high temperatures is further developed, it might become more advantageous to filter the final hard pitch product since its volume is only half that of the dehydrated tar.

The filter elements preferably employed are long cylinders of porous ceramic material, each having several parallel flow channels lined with ceramic membranes that have sub-micron size pores. The raw liquid is pumped repeatedly (circulated) through the channels at elevated pressure, e.g., 100–200 psig. The space outside the filter element is kept at a lower pressure, close atmospheric. The pressure differential is the driving force for the flow crossing the filter elements. The membrane allows the liquid itself to penetrate through the fine pores and to flow outside of the filter element, but blocks the flow of the solid particles. A solids-free liquid is collected outside of the filter element, while a solids-enriched liquid is released from the circulating stream.

Flow rate through a porous medium is inversely proportional to the viscosity of the fluid. The lower the viscosity, the higher the permeation rate through the pores. Filtration trials of tars have been carried out using commercial tubular ceramic membranes produced by U.S. Filter operating in a cross-flow configuration shown schematically at 1 in FIG. 1. Suitable ceramic filter membranes can also be obtained from Rhône-Poulenc and CERAMEM. A porous membrane indicated at 3 typically consists of selective layers of alpha alumina, zirconia, or gamma alumina deposited on an alpha alumina support. The substantial chemical stability offered by these materials makes ceramic membranes resistant to wide range of organics, including the aromatics present in coal tar. In addition, ceramic membranes are stable at relatively high temperatures. High temperature operation (i.e., >80° C.) is required to reduce the viscosity of a tar so that a practical filtration rate (i.e., permeation flux) may be attained. This may be achieved by incorporating the simultaneous Q.I. enrichment/depletion process of the present invention directly into a coal tar distillation process, where the intermediate coal tar products are typically processed at these temperatures.

In cross-flow filtration, illustrated schematically in FIG. 1, feed 5 flows parallel (rather than perpendicular) to the surface of membrane 3. The feed stream 5 is kept at a higher pressure than the permeate (i.e. filtrate) 7 so that a cross-flow of permeate passes through the pores of membrane 3. Particles larger than the membrane pores do not pass through the membrane and, hence, remain in the feed stream. Some of the particles, indicated at 8, form a thin layer at the membrane surface which increases the resistance to permeate flow. However, the parallel flow through the tube creates shear forces which keep this layer thin. Thus a filter cake does not continuously accumulate with time as with dead-end filtration and the permeation flux reaches a substantially constant value. In practice, after long-term, a flux decline may occur due to internal fouling of the membrane. However, the rate of long-term decline is much slower than the flux decline due to cake formation in dead-end filtration.

In addition to chemical and thermal stability, ceramic membranes possess high strength and relatively strong bonds between the layers that make up the membrane. These properties allow ceramic membranes to be backflushed periodically in order to restore the permeation flux. Backflushing involves reversing the flow of permeate to remove particles trapped in the membrane.

Figure 2:
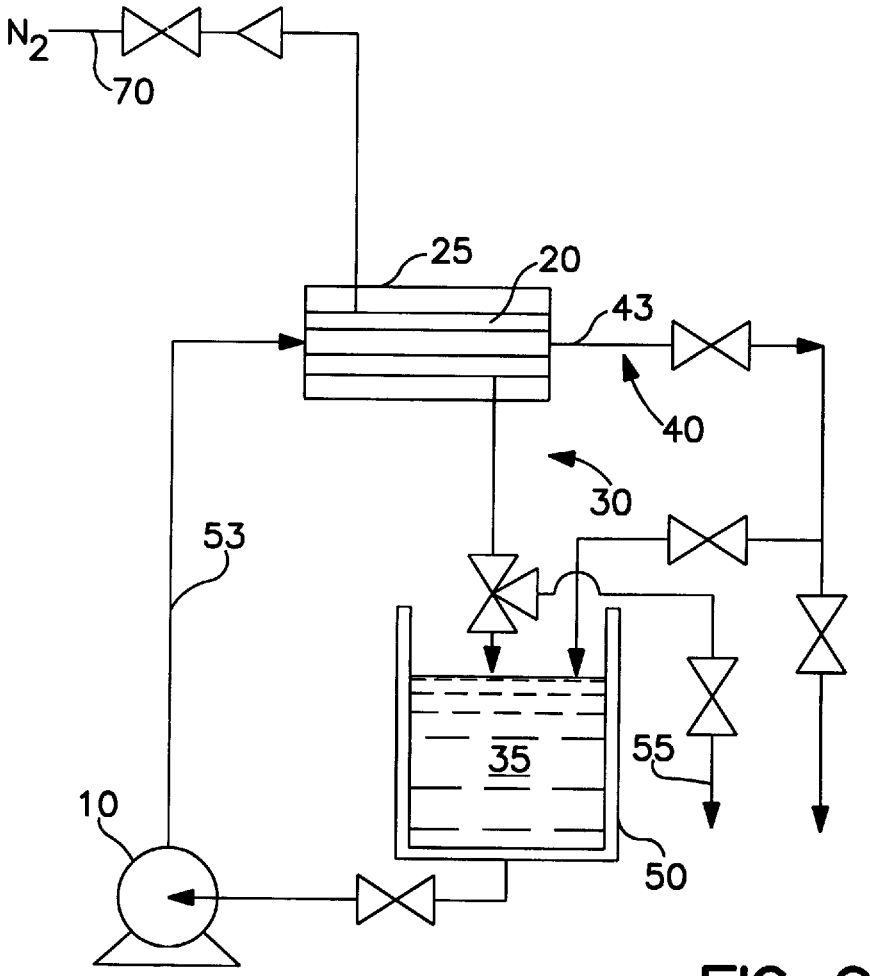
FIG. 2 is a schematic representation of an experimental system using a cross-flow ceramic membrane filter.

A schematic of an experimental apparatus used to investigate removal of Q.I. particles from coal tar is shown in FIG. 2. A rotary lobe positive displacement pump (Jabsco Pureflow Model A1) 10 was used to deliver liquid coal tar or a coal tar/toluene mixture 35, containing Q.I. particles, to a ceramic membrane filter 20. Feed pressures between 40 and 110 psig, and feed flow rates between three and seven gpm (gallons per minute) were used in the investigation. The feed delivered to membrane 20 is divided into two streams by the membrane: a concentrate 40 having increased Q.I. content (as compared to the Q.I. content of the entering stream), and a permeate 30 which is Q.I. free. The permeate stream 30 is returned to the feed tank 50 as indicated or can go through valve 55 as product. Due to axial pressure drop in the tubular membrane 20, the pressure of the concentrate stream at the exit of the membrane 20 is typically 10–30 psi less than the feed pressure at the inlet to membrane 20. The pressure of permeate stream 30 is maintained at a few psig and returned to the feed tank 50, or removed from the system as indicated at 55. By recycling both the concentrate 40 and permeate 30, a constant particle concentration in the feed was maintained during the trials and removal of a portion of permeate 30 results in an increase of the concentration of Q.I. particles in the concentrate.

To provide heat to the experimental system and maintain the pitch at elevated temperature, the feed tank 50, the tubing 53 between the feed tank and the membrane 20, the pump 10, and the permeate line 43 were conventionally traced with electrical tape (not shown) and insulated. The temperature in the tank was controlled with an Athena temperature controller (not shown). The heat input to the pump 10 and the process lines was controlled by varying the voltage input to the heat tape with a Variac (not shown). Temperatures were monitored with thermocouples in the feed tank, the concentrate stream, and the permeate line. Back flushing to remove accumulated solids was achieved by filling the outer shell 25 of membrane 20 with permeate. A fifteen second pulse of nitrogen at a pressure 20 psi greater than the feed pressure may be applied to the filled outer shell of the membrane to reverse the flow of permeate through the pores.

Filtration tests were carried out using the system of FIG. 2 and ceramic membranes with average pore sizes ranging from 0.05 to 0.2 micron. Tests have shown a sharp decrease in the permeate flux early in a run followed by a slower decrease (i.e., leveling off) in the permeate flux as the run continued. The initially sharp decrease in permeate flux is typical of cross-flow filtration processes and is usually attributed to the buildup of particles at the surface of the membrane in contact with the feed. The permeate flux levels off with time as the layer of retained solids reaches a constant thickness. Since particle accumulation at the membrane surface may be responsible for the decline in permeate flux, backflushing should have temporarily increased the permeate flux. Although membranes with pores 0.2 micron in size and larger can be used to produce a solids-free permeate, these membranes have not been satisfactory in a continuous flow/backflush operation to concentrate the Q.I. Data has shown that unlike a 0.2 micron membrane, a 0.1 micron membrane does not become irreversibly clogged with solids and that the system could be practically operated in a continuous manner with periodic backflushing. In each instance, the permeate removed contained 0 wt % solids. Results of these tests show that pore sizes of 0.1 micron or less are needed to prevent entrapment of the solids into the pores and enable continuous operation employing backflushing.

It has been demonstrated that it would be both feasible to carry out the Q.I. concentration/removal with crude (raw)

tar. Experiments have been carried out with crude (raw) coal tar using a 0.05 micron (500 Angstrom) ceramic filter, which has a reduced chance of pore plugging with the Q.I. particles, at temperatures of 80°–90° C. (above the storage temperature, 65° C.) where the tar has a viscosity of 28cps or lower. The results have indicated that a 500 Angstrom filter membrane was able to produce a solids-free permeate during all runs, and that by removing permeate from the system rather than returning it to the feed tank, it was possible to concentrate Q.I. particles in the feed stream. It has also been shown that an increase in the feed flow rate results in an increased permeation flux across the membrane. This result is expected since high flow rates result in a thinner filter cake at the membrane surface.

Figure 3:
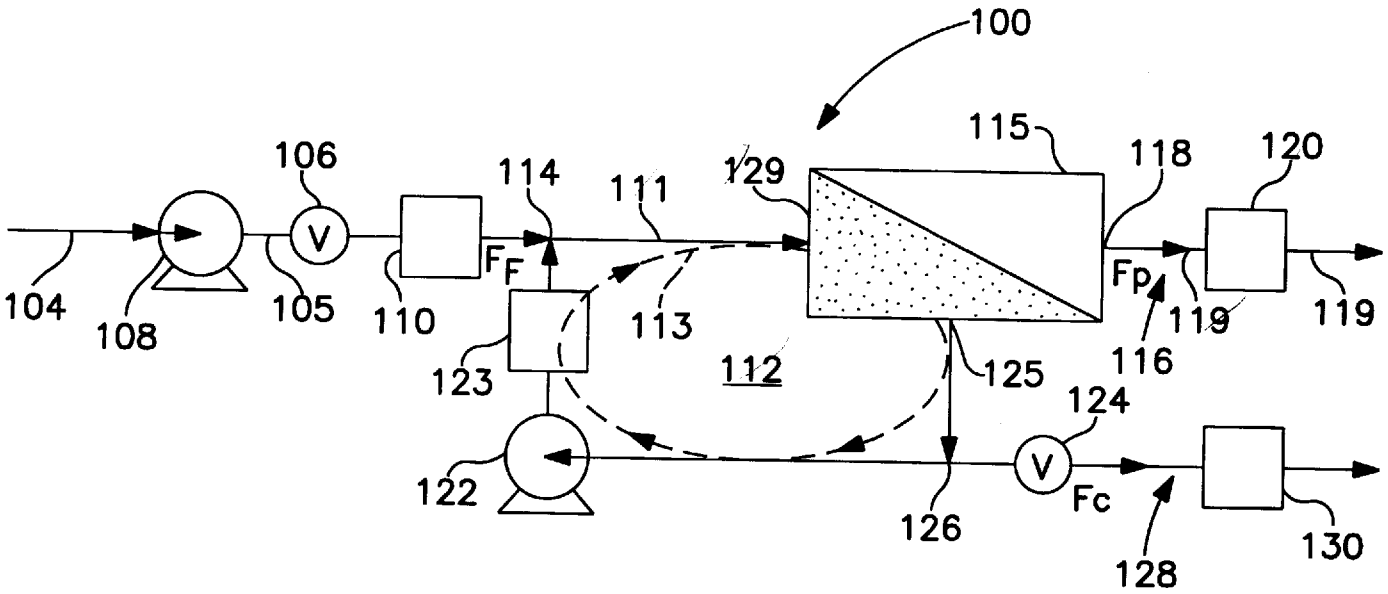
FIG. 3 is a schematic representation of a system in accordance with the present invention for continuous concentration of Q.I.-containing tar with the concurrent production of Q.I.-free tar.

With reference to FIG. 3, there is shown as 100 a system for a continuous-operation Q.I. particle filtration and concentration unit for processing Q.I. containing liquid tar which may be employed in coal tar distillation systems. Unit 100 comprises a system inlet 103 which contains Q.I. containing coal tar feed material which is diverted in the course of otherwise normal coal tar processing. The tar feed material is at a temperature in the range of 80°–320° C. typical of intermediate coal tar distillation stages in order to reduce the viscosity to a minimum value without the occurrence of volatilization or chemical reaction in the tar. The particular temperature for minimum viscosity for different tars will vary and is determined by routine measurement. With valve 106 open, the tar feed is moved through conduit 105 by pump 108 and mass flow controller 110 into circulation loop 112 through loop inlet 114. The fresh Q.I. containing tar feed thus introduced into circulation loop 112 passes by way of conduit 111 into the inlet 129 of membrane filter 115 and a Q.I. free liquid tar permeate 116 exits filter 115 at 118, and the circulation loop 112, at 130. A desired Q.I. free liquid tar permeate flow rate is established by observation of mass flow meter 120 while correspondingly adjusting the flow of tar feed into circulation loop 112 at 114 so that the amount (quantity) of tar being circulated in loop 112 remains substantially constant while being repeatedly circulated as shown at 113 at a high rate of flow in loop 112, by high pressure pump 122 in conjunction with mass flow controller 123. In the course of the repeated circulation of liquid tar in loop 112 the concentration of Q.I. in this circulating liquid tar is increased due to permeate removal from loop 112. With a desired Q.I. free permeate flow rate established at 116 in conduit 119, valve 124 is opened and liquid tar concentrate 128, i.e. tar of higher Q.I. concentration then feed 104, is withdrawn from circulation loop 112 at outlet 126. That is, the Q.I. concentration in the liquid tar circulating in the portion of loop 112 between the exit 125 of filter 115 and feed inlet 114, $C_1$, is the same as the Q.I. concentration, $C_c$, in the liquid tar concentrate 128. The flow of liquid tar concentrate (high "Q.I.") 128 is measured at mass flow meter 130 and the amount of tar feed introduced at 114 into circulation loop 112 before filter 115 is correspondingly increased.

The Q.I. concentration and flow rate of the tar concentrate released from the circulation loop at 126 is determined by the following relationship:

$$C_c = \frac{C_f \times F_f}{F_f - F_p} \quad \text{(I)}$$

$$F_f - F_p = F_c \quad \text{(II)}$$

where $C_c$=Q.I. concentration in weight percent in the tar concentrate (128).

$C_f$=Q.I. concentration in weight percent in the tar feed (104)

$F_f$=the flow rate of the tar feed (104)

$F_p$=the flow rate at which Q.I. free permeate (116) exits filter and circulation loop.

$F_c$=the flow rate at which tar concentrate (128) is withdrawn from the circulation loop.

Figure 4:
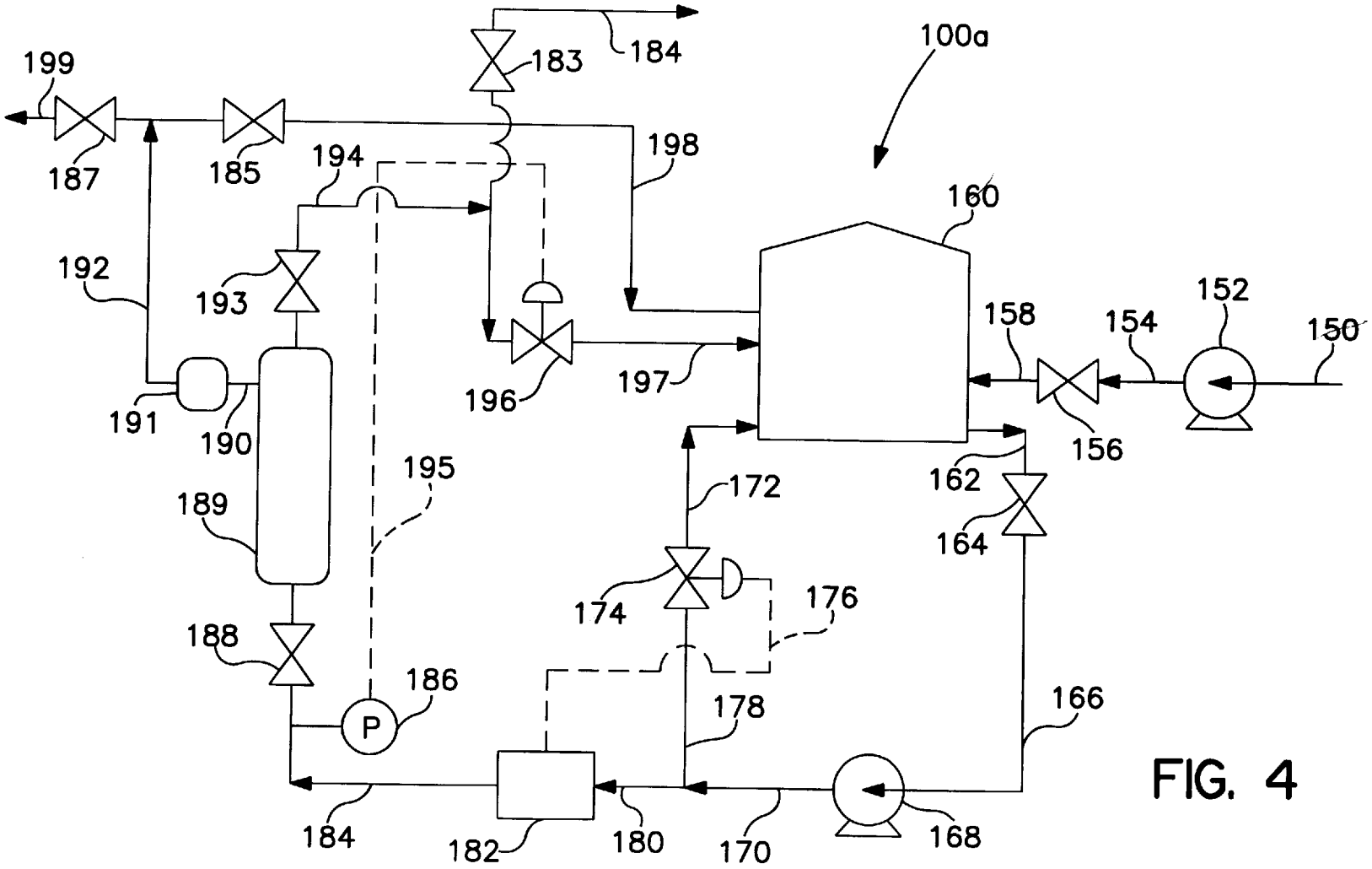
FIG. 4 is a schematic representation of a pilot scale microfiltration plant in accordance with the present invention for continuous concentration of Q.I.-containing tar with the concurrent production of Q.I.-free tar.

In FIG. 4 there is shown a pilot scale microfiltration plant 100*a*. Conduit 150 receives a coal tar intermediate product pumped by charging pump 152 through conduit 154, 158 and valve 156 to a tar feed tank 160. A tar circulating loop comprises as its major components a vertical filter module 189 containing a ceramic filter element, a tar feed tank 160, and a tar circulating pump 168. The additional system components include mass flow meters 182, 191, flow control valves 174, 188 a flow rate controller (not shown), pressure transducer 186, a pressure controller (not shown) and pressure control valve 196.

The flow control loop 176 consists of mass flow meter 182, a flow rate controller (nor shown) and flow control valve 174. The circulation flow rate through the filter module is regulated by the loop so that the tar stream from conduits 162, 166, valve 164 and pump 168 through conduit 170 is split into two streams through conduits 178 and 180. The stream through conduit 178, 172 and valve 176 is returned to the feed tank 160 directly. The stream through conduits 180, 184 and mass flow meter 182 goes into the filter module 189, exits into valve 193, conduit 194, 197 and returns back into feed tank 160.

The pressure control loop 195 consists of pressure transducer 186, a pressure controller (not shown) and pressure control valve 196.

The permeate exits the filter module 189 through conduit 190, 192 mass flow meter 191 and valve 185 and can be directed either through conduit 198 back into feed tank 160 or through valve 187 and conduit 199 to a permeate storage tank.

The Q.I.-enriched tar can be removed from the system through valve 183 and conduit 184 to a storage tank.

Figure 5:
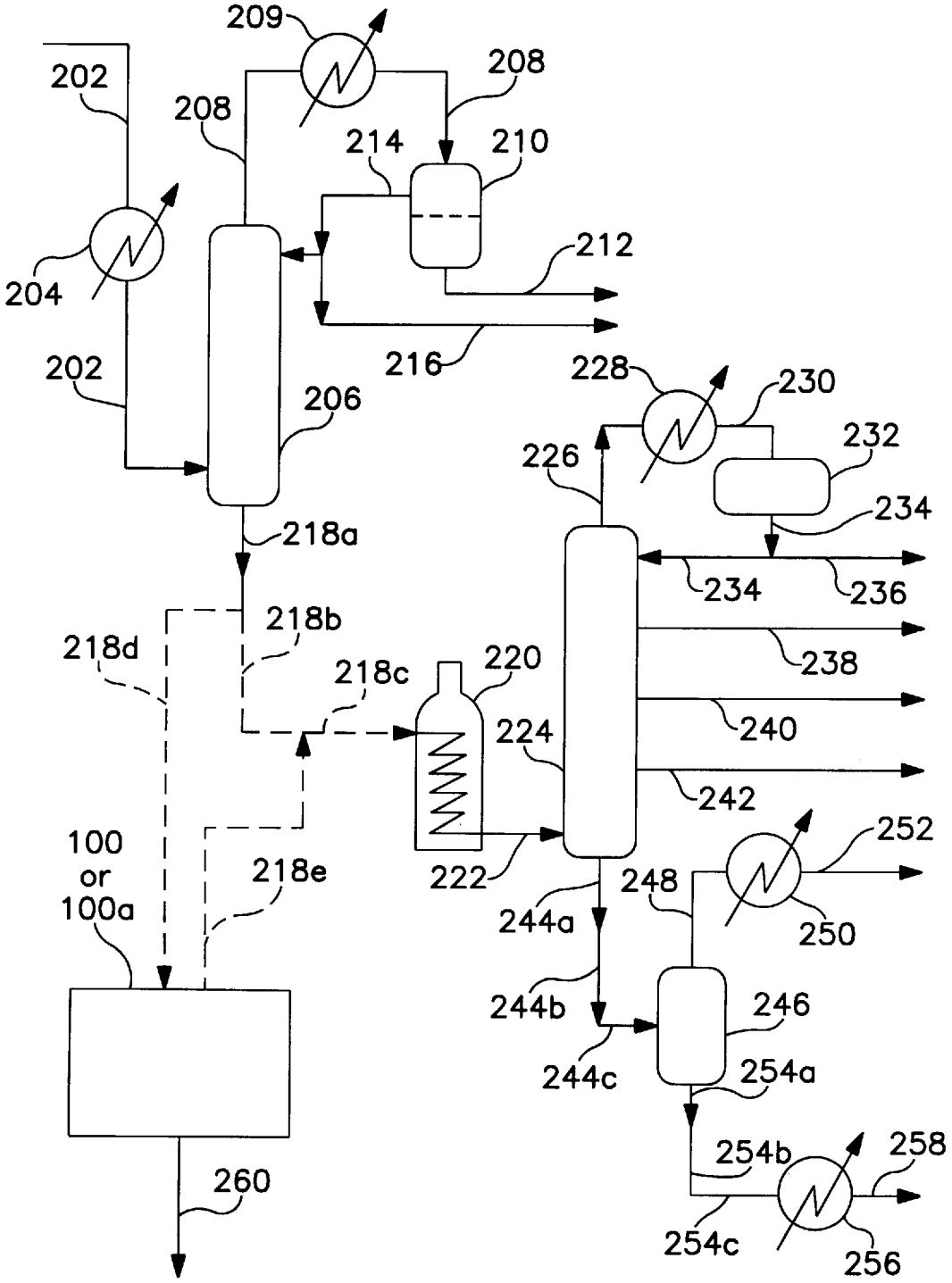
FIG. 5 is a schematic representation of a first portion of one preferred embodiment of a coal tar distillation plant utilizing the system of FIGS. 3 or 4.
Figure 6:
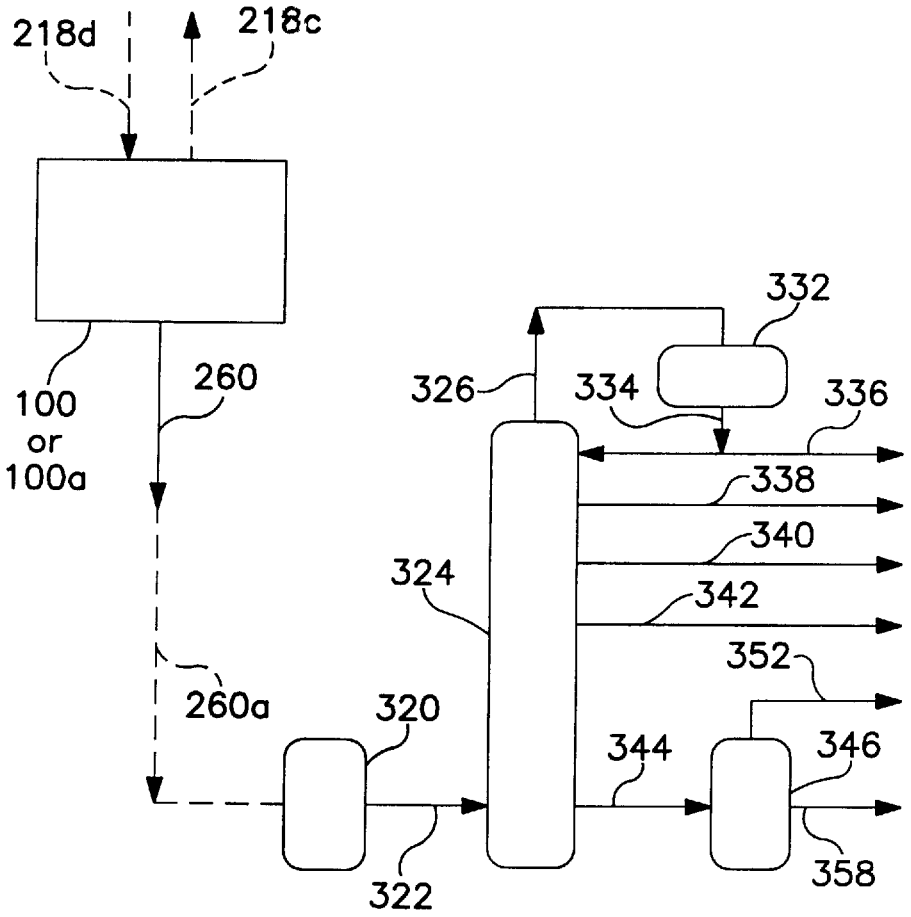
FIG. 6 is a schematic representation of the second portion of the coal tar distillation plant of FIG. 5.

The present invention using the filtration systems described above may be incorporated into a typical coal tar distillation system is shown in FIGS. 5 and 6. As shown therein, either filtration system 100 (FIG. 3) or 100*a* (FIG. 4) may be used at the intermediate distillation points indicated.

In a typical prior art coal tar distillation process, crude coal tar is pumped by conduit 202 from storage at 65° C. through a series of heat exchangers 204 where it is preheated to about 160° C. and enters the dehydrator tower 206. Water, ammonia and a small amount of oil are flashed overhead of the dehydrator through conduit 208, condensed in heat exchanger 209, and separated into two liquid layers in drum 210. Ammoniacal water (which may comprise about 5% of the crude coal tar)is released through conduit 212. The condensed hydrocarbons which may comprise about 1% of the crude coal tar and which boil below about 170° C., generally known as light oil, are returned to the dehydrator as reflux through conduit 214 and the net light oil is released to tankage through conduit 216.

The dehydrated tar is passed through conduits 218*a*, 218*b* and 218*c* to be heated in fired heater 220 to a temperature sufficient for flashing off most of the tar distillate fractions and enters fractionation column 224 through conduit 222. In the fractionator, the flashed vapors are separated by boiling range into several distillate products whose boiling ranges may be different in different distilleries depending on mode of operation. Even the names of the products may vary. For example, carbolic oil (also known as phenolic oil) with about a 170°–200° C. boiling range passes through conduits 226 and 230 to be condensed in heat exchanger 228 and separated in tank 232, and recycled and passed out through conduits 234, 236. Naphthalene oil of about 200°–230° C. boiling range is removed via conduit 238. Wash oil (sometimes separated into light wash oil and heavy wash oil) of about 230° to 300° C. boiling range is removed via conduit 240, and creosote oil, sometimes called anthracene oil, boiling generally above 300° C. is removed via conduit 242. Soft pitch, also called heavy tar, is removed from fractionator 224 and passes through conduit 244*a*, 244*b* and 244*c* to be flashed again, usually under vacuum, in flash drum 246 to produce the final hard pitch product exiting through conduits 254*a*, 254*b* and 254*c*. Vapors separated in the flash drum pass through conduit 248 to heat exchanger 250 to be condensed and removed via conduit 252, whereupon they are usually added to the heaviest distillate stream. After exiting flash drum 246, the hot hard pitch is cooled by heat exchanger 256 versus incoming crude tar to approximately 250° C. or less and is pumped to storage through conduit 258.

Pitch Production by Cross-Flow Filtration of Dehydrated Tar

In a first embodiment depicted in FIGS. 5 and 6, tar distillation by cross-flow filtration plant 100 or 100*a* is installed on the dehydrated tar stream exiting through conduit 218*a*. The typical properties of the dehydrated tar are as follows:

| Temperature (°C.) | Viscosity (cp) |
|---|---|
| 55 | 66 |
| 80 | 21 |
| 105 | 9 |
| 130 | 5 |
| 155 | 3 |
| 180 | 2 |

Moisture content: 0.15 wt. % Max; Density 1.18 g/cc

Instead of passing through conduit 218*b*, the dehydrated tar stream at elevated temperature of about 160° C. is diverted through conduit 218*d* to system 100 or 100*a* which operates as described previously and produces simultaneously a Q.I. solids-free dehydrated tar which exits through conduit 260 and a Q.I. solids-enriched dehydrated tar, as compared to Q.I. content of the entering dehydrated tar. The solids-enriched tar passes through conduit 218*e* to conduit 218*c* and continues on to be distilled into Q.I. solids-enriched pitch and tar distillates as described previously. As shown in FIG. 6, the solids-free dehydrated tar passes through conduit 260*a* and into similar downstream fractionation and other processing equipment as described previously, except that the feature number begins with the numeral 3 instead of the numeral 2. The solids-free dehydrated tar is distilled into solids-free pitch and tar distillates as described previously. Both sets of tar distillates from Q.I. enriched and Q.I. free streams are equivalent and may be blended and used together if desired.

Pitch Production by Cross-Flow Filtration of Soft Pitch

Figure 7:
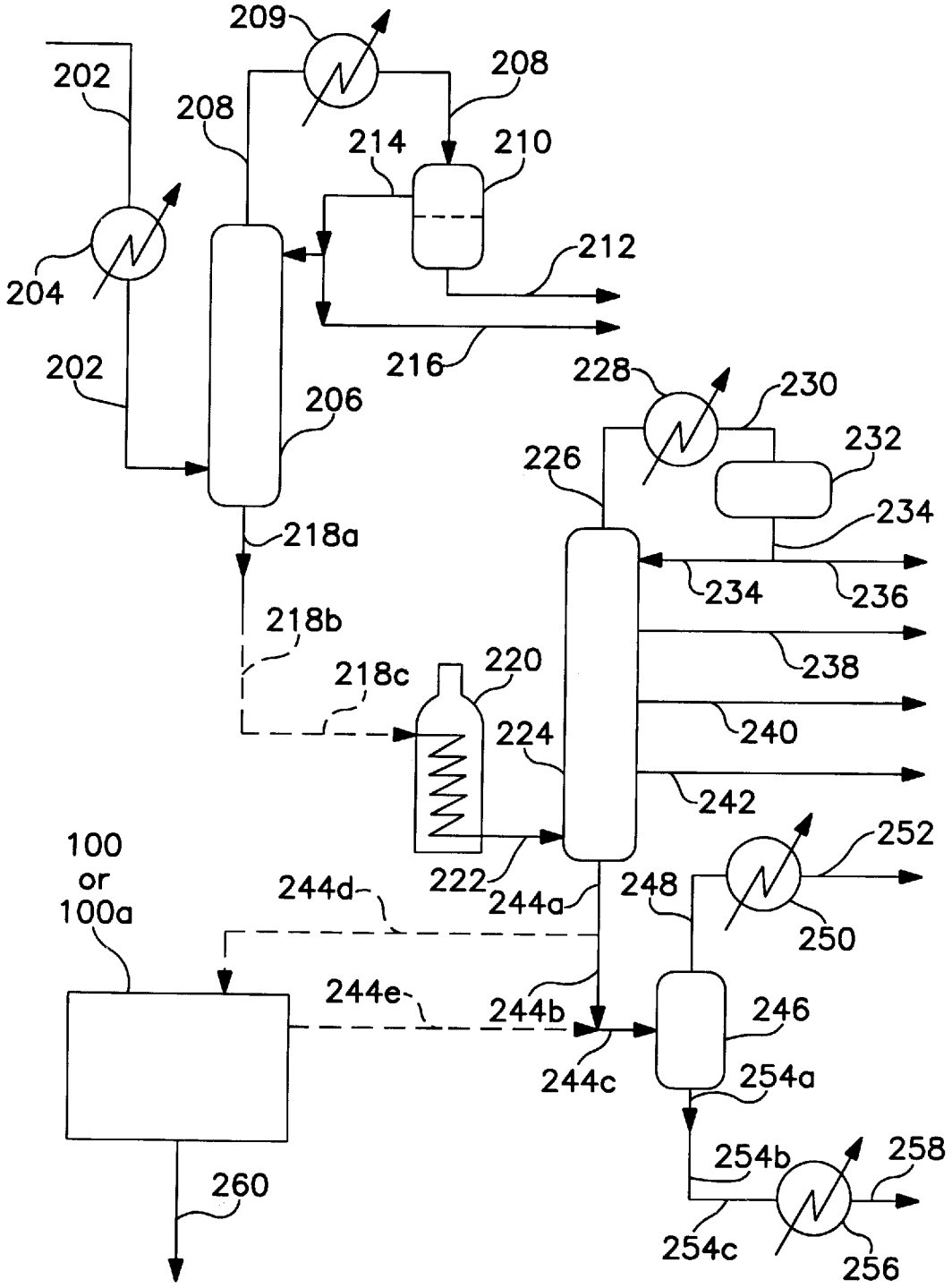
FIG. 7 is a schematic representation of a first portion of another preferred embodiment of a coal tar distillation plant utilizing the system of FIGS. 3 or 4.
Figure 8:
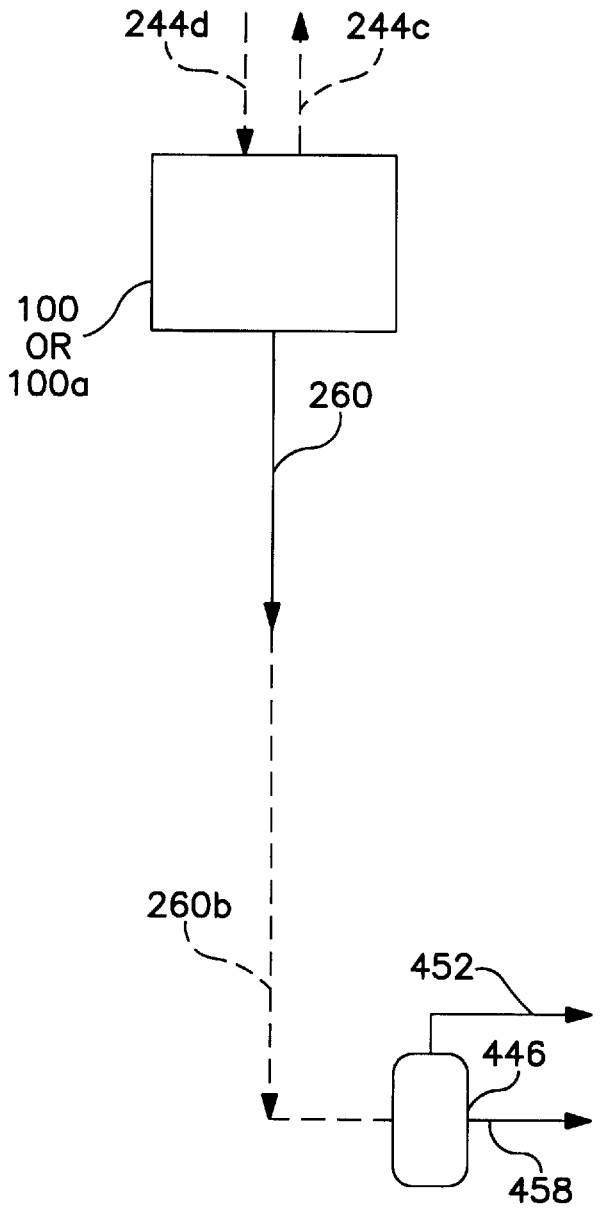
FIG. 8 is a schematic representation of the second portion of the coal tar distillation plant of FIG. 7.

In another embodiment depicted in FIGS. 7 and 8, a cross-flow filtration plant 100 or 100*a* is installed at the soft pitch stream that leaves the bottom of the tar fractionator 224 via conduit 244*a*.

Instead of passing through conduit 244*b*, the soft pitch stream is diverted through conduit 244*d* to filtration system 100 or 100*a* which operates as described previously and produces simultaneously a Q.I. solids-free soft pitch which exits through conduit 260 and a Q.I. solids-enriched soft pitch, as compared to Q.I. content of the entering soft pitch. The solids-enriched soft pitch passes through conduit 244*e* to conduit 244*c* and continues on to be flashed in drum 246 into Q.I. solids-enriched hard pitch and tar distillates as described previously. As shown in FIG. 8, the solids-free soft pitch passes through conduit 260*b* and into similar downstream processing equipment as described previously, except that the feature number begins with the numeral 4 instead of the numeral 2. The solids-enriched soft pitch is flashed in a vacuum flash drum 246 (FIG. 7) into solids-enriched hard pitch, plus a vacuum distillate stream. The solids-free soft pitch is flashed in vacuum flash drum 446 (FIG. 8) into solids-free hard pitch and a tar distillate. Again, both sets of tar distillates from Q.I. enriched and Q.I. free streams are equivalent and may be blended and used together if desired.

Pitch Production by Cross-Flow Filtration Of Hard Pitch

Figure 9:
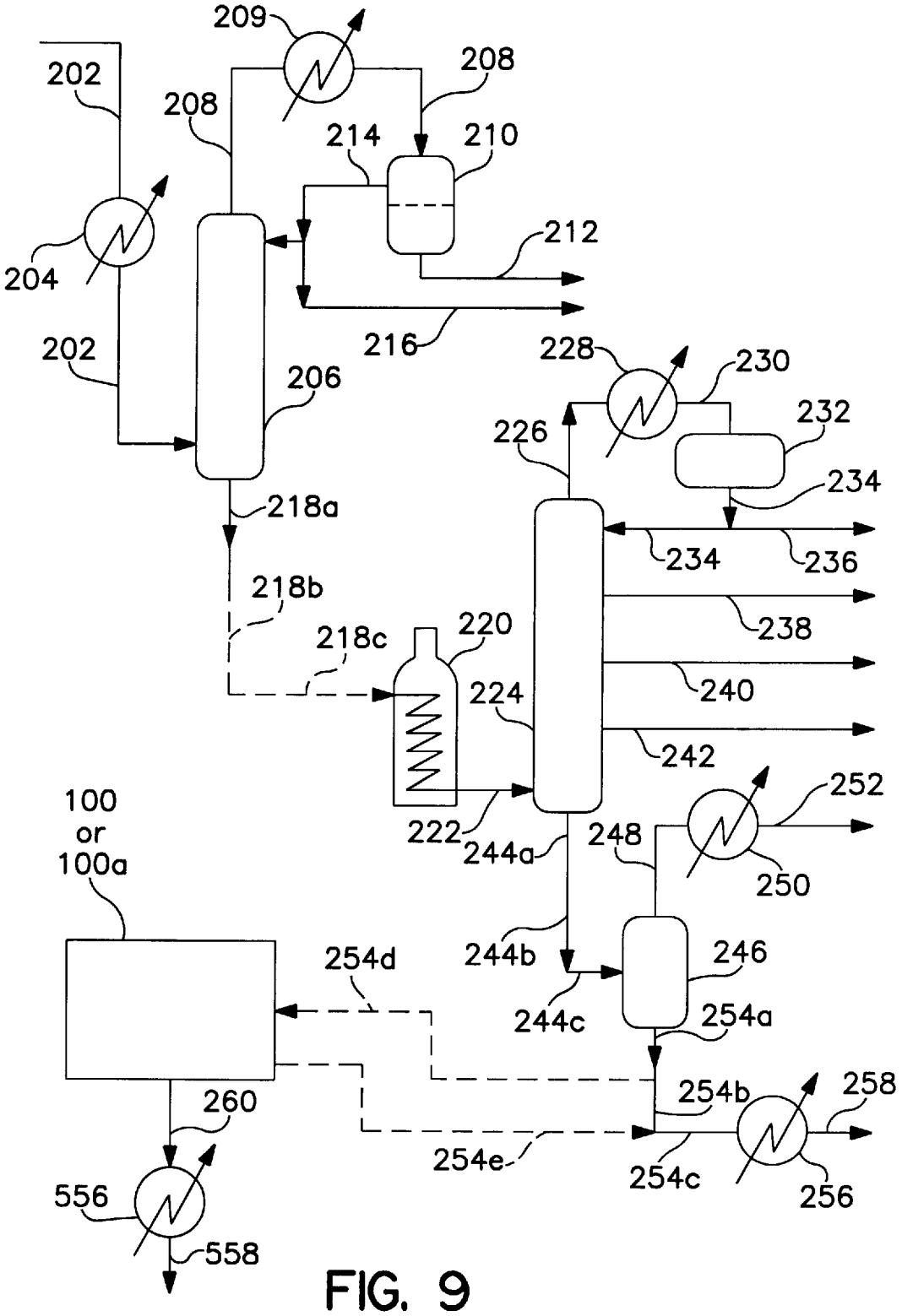
FIG. 9 is a schematic representation of yet another preferred embodiment of a coal tar distillation plant utilizing the system of FIGS. 3 or 4.

In another embodiment depicted in FIG. 9, a cross-flow filtration plant 100 or 100*a* is installed on the hard pitch stream that leaves the bottom of the flash drum 246 via conduit 254*a*. Typical properties of coal tar pitch are as follows:

| Viscosity for 110° C. SP pitch: | |
|---|---|
| at 160° C.: | 1100 cp |
| at 200° C.: | 100 cp |
| at 225° C.: | 30 cp |

Instead of passing through conduit 254*b*, the hard pitch stream at elevated temperature of about 330° C. or above is diverted through conduit 254*d* to filtration system 100 or 100*a* which operates as described previously and produces simultaneously a Q.I. solids-free hard pitch which exits through conduit 260 and a Q.I. solids-enriched hard pitch which exits through conduit 254*e*. The filtration system produces simultaneously a solids-free pitch exiting through conduit 260 and 558 and a solids-enriched pitch, as compared to Q.I. content of the entering pitch. After separately cooling both pitches to the desired storage temperature in heat exchangers 256, 556, they are pumped to tankage (not shown).

In the description of the process of converting coal tar to Q.I.-enriched and Q.I.-free pitch products described above, the Q.I.-enriched stream is described as being processed in parallel with the Q.I.-free stream with separate equipment. Alternatively, it would be possible for the Q.I.-free stream to be processed on a blocked basis on the same equipment. In other words, one of the Q.I.-enriched or Q.I.-free streams could be pumped to tankage and stored while the distillation of the other proceeds until a desired amount is completed, whereupon the stored stream is then introduced into the desired point in the distillation process and conversion into hard pitch is completed.

Further, the process for converting coal tar described above is a continuous process, both as for the dehydration and distillation steps and for the microfiltration that produces the Q.I.-enriched and Q.I.-free streams. While the microfiltration process will remain continuous, a batch process may be employed for each of the dehydration and distillation steps in place of the continuous process described above.

EXAMPLE 1

In a continuous microfiltration plant 100 for Q.I. concentration of liquid tar and concurrent production of Q.I. free tar as shown in FIG. 3, ceramic membrane filter 115 (U.S. Filter) may be housed inside a stainless-steel case and have a nominal pore diameter of 500 angstrom and a total surface area of 75 $ft^2$. The fresh feed of coal tar from the coal distillation process is between 80° and 350° C. to minimize viscosity and pumped into the "circulation" process loop 112 which includes a large WAUKESHA positive displacement pump 122, the U.S. Filter ceramic membrane module 115 and a MICRO MOTION mass flow controller 123. The temperature of the circulation process lop is likewise maintained at the minimum viscosity temperature between 80° and 350° C. using hot oil tracing.

The flow rates of fresh feed 104, concentrate 128, and recirculation 113 are respectively regulated by MICRO MOTION mass flow controllers 110, 130, 123. The flow rate of permeate is metered with a MICRO MOTION mass flow meter 120. The flow rates of fresh feed 104 and concentrate 128 are controlled according to the initial Q.I. level in the fresh coal tar feed 104, the desired Q.I. level of the concentrate 128, and the flow rate of permeate 116. The flow rate of coal tar 111 inside the "recirculation" process loop is maintained very high, 50 to 10,000 times the flow rate of the fresh feed 104, in order to create and maintain a turbulent flow inside the tubular ceramic membrane.

A material balance of the system with permeate from the membrane filter being Q.I. free gives the following:

(1) $F_f=F_p+F_c$ (2) $F_p \times C_f=F_p \times C_p+F_c=F_c \times C_c$ ($C_p$=O)

where $F_f$, $F_p$, and $F_c$denote the respective flow rates of the fresh feed, permeate, and concentrate and $C_f$, $C_p$ and $C_c$ denote the solid wt. % correspondingly. As indicated in previous examples, with cross-flow filters, $C_p$ is equal to zero; i.e., the permeate is Q.I. free.

From previous tests, the permeation flux, will be approximately 10 gallon/$ft^2$/day (gfd) for filtering coal tar with the use of a 500 Angstrom membrane. The permeation flow rate, $F_p$, is determined as follows:

$F_p$=(permeate flux)×(filter surface area)

$F_p$=10 gallons/$ft^2$/day×75 ft $F_p$=750 gallons permeate/day=31.3 gallons permeate/hr.

If the fresh feed has 1 wt % solids (Q.I.), $C_f$, concentrating the tar to contain 3, 4, and 5 wt % Q.I. solids can be achieved by operating the system according to the following sets of conditions:

| | $C_c$ = Solid wt. % in the Concentrate | | |
|---|---|---|---|
| $C_f$ = 1 wt. % | 3 wt. % | 4 wt. % | 5 wt. % |
| Fresh Feed Rate Gallons/Hr.-$F_f$ | 46.9 | 41.7 | 39.1 |
| Permeate Rate Gallons/Hr.-$F_p$ | 31.3 | 31.3 | 31.3 |
| Concentrate Rate, Gallons/Hr.-$F_c$ | 15.6 | 10.4 | 7.8 |

Similarly, concentrating a 1.5 wt %—solid feed 3, 4, and 5 wt % tars requires the following operation conditions:

| | $C_c$ = Solid wt. % in the Concentrate | | |
|---|---|---|---|
| $C_f$ = 1.5 wt. % | 3 wt. % | 4 wt. % | 5 wt. % |
| Fresh Feed Rate Gallons/Hr.-$F_f$ | 62.6 | 50.0 | 44.7 |
| Permeate Rate Gallons/Hr.-$F_p$ | 31.3 | 31.3 | 31.3 |
| Concentrate Rate, Gallons/Hr.-$F_c$ | 31.3 | 18.7 | 13.4 |

In the foregoing exemplary situations, the fresh feed rate $F_f$ is adjusted until the permeate rate $F_p$ reaches 31.3 gallons per hour, with the circulation in loop 112 being about 100,000–3000,000 gallons per hour and valve 124 being closed so that there is no flow of concentrate from circulation loop 112. Upon attaining a constant permeate flow rate $F_p$ of 31.3 gallons per minute, valve 124 is opened and tar concentrate is withdrawn from circulation loop 112 at the rate $F_c$ corresponding to the desired Q.I. concentration $C_c$ by operation of mass flow controller 130; concurrently, the fresh feed flow rate $F_f$ is increased by amount of withdrawn tar concentrate $F_c$.

EXAMPLE 2

Several dehydrated tars were filtered in a pilot microfiltration plant as shown in FIG. 4 at pressures up to 150 psig (10 bar) and temperatures up to 175° C. Several commercial filter elements in module 189 were tested, including some 80 cm tall and some 120 cm tall. Most contained 19 flow channels, which were either 6 mm or 3.5 mm inside diameter. The ceramic membranes on the internal surfaces of the flow channels had pore sizes of 0.1 micrometer or smaller.

The tar circulation rates ranged roughly from 15 gpm to 60 gpm (60 to 240 liters per minute) resulting in tar linear velocities in the flow channels ranging from 2 m/s to 8 m/s. The original tars contained from 2% to 8% solid (Q.I.) particles. The permeate was substantially free of solids (less than 0.1%).

During part of the experimental work the permeate was recombined with the solids-enriched tar and the recombined tar was filtered again repeatedly to obtain technical data over longer time. In simulating commercial operation, the permeate was withdrawn and the tar with increasing solids content was circulated through the filter until the yield of permeate reached at least 10% of the original tar. Yields of solids-free permeate of more than 40% of the original tar have been obtained, although this is higher than what a typical plant would be expected to produce, which would be in the range of about 10–20 weight percent of the original tar. Higher percentages of Q.I.-free pitch, in the range of 30–40%, would also be less desirable since this would mean higher viscosity of the remaining Q.I.-enriched stream in the distillation process.

Figure 10:
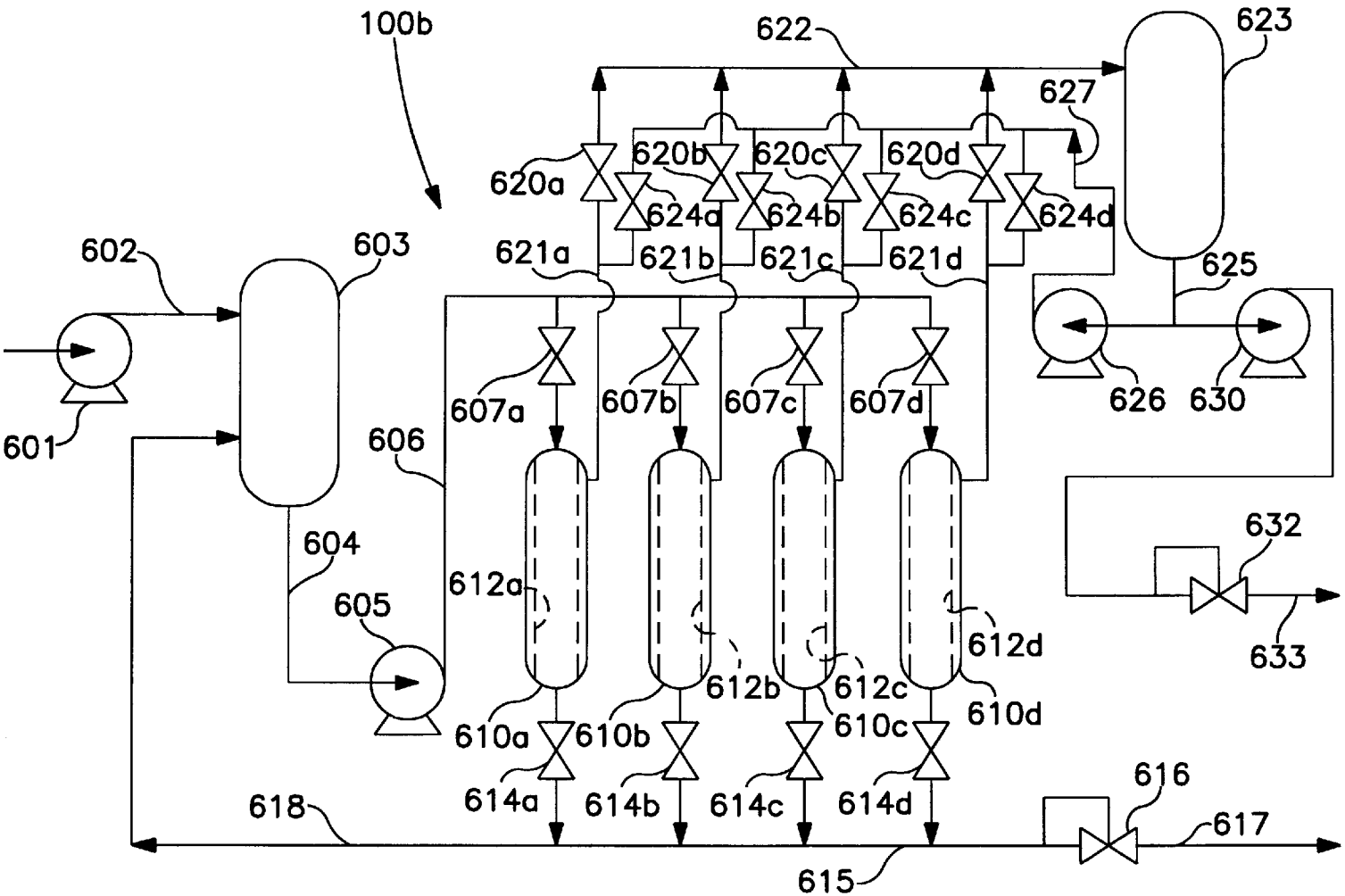
FIG. 10 is a schematic representation of another preferred microfiltration plant for use in a coal tar distillation plant.

A commercial plant would be expected to use the same size filter elements, but would have several of them in one module and use as many modules as needed for the desired capacity. An example of such a plant is shown in FIG. 10. In plant **100*b*, fresh feed (either dehydrated tar, soft pitch or hard pitch) is brought in at atmospheric pressure through pump 601, e.g., at 100 gal./min., and pressurized to about 40 psig or greater. The feed then enters through conduit 602 and is continuously pumped, e.g., at 9000 gal./min., into a loop of circulating liquid that is maintained at elevated pressure and temperature. The loop consists of a circulating pump 605, a plurality of filter modules 610***a–d* each containing ceramic-membrane filters 612*a–d*, a reservoir drum 603 and connecting piping 604, 606, 615, 618 and control valves 607*a–d* and 614*a–d*. At the example the circulation rate is such that linear velocity in the filter channels is between 2 m/s and 8 m/s.

The liquid in the loop is continuously pumped through the channels of the ceramic filters 612*a–d* under turbulent flow conditions. A minor portion of the circulated liquid permeates through the ceramic membranes which prevents solid particles from crossing. The solids-free liquid is collected though conduits 621*a–d*, valves 620*a–d* and conduit 622 into the permeate drum 623 which is maintained at slightly above atmospheric pressure, e.g., at 5–10 psig.

The solids-free liquid can be used for backflushing, through pump 626, conduit 627, valves 624*a–d* and conduit 621*a–d*, the filter modules 610*a–d* at regular intervals. The net produced solids-free liquid is released from drum 623 through conduit 625, pump 630, control valve 632 and conduit 633 under level control. For example, for 100 gal./min. entering feed, the Q.I.-free stream may be 9 gal./min.

As a portion of the solids-free liquid leaves the loop as a stream, the concentration of solid particles in the remaining liquid increases. The net solids-enriched liquid is released from the loop as a stream, e.g., by a back pressure controller 616 and conduit 617 at the rate of 91 gal./min. Both the Q.I.-free and Q.I.-enriched streams are then separately processed to produce the Q.I.-free pitch and the Q.I.-containing pitch as described previously.

Thus, the present invention achieves the process for distilling coal tar containing quinoline-insoluble solids (Q.I.) whereby there is produced a solids (Q.I.) enriched coal-tar pitch product while simultaneously producing a substantially Q.I.-free coal tar pitch product. Because the distillates and other products removed through the course of dehydration and fractionation do not contain Q.I., the Q.I. in the entering tar will concentrate in the pitch produced by prior art process so that the finished pitch will have a higher Q.I. content than that of the entering coal tar. However, in the process of the present invention, the Q.I.-containing product will have a higher Q.I. concentration than that which would have been expected from prior art processes.

One advantage of incorporating the simultaneous Q.I. enrichment/depletion process in the course of coal tar distillation in accordance with the present invention is that the filtration rate on an internal stream is several times higher than the filtration rate of either the tar or the pitch at their storage temperatures. Fewer filter elements and a lower volume of pumped liquid per ton of product will be needed. Another advantage over filtering crude coal tar is that complications with a two-phase tar/water flow are avoided.

Such cross-flow Q.I. filtration in the course of coal tar distillation fits commercial needs, because the carbon and graphite producers favor using solids-free pitch for impregnation, and solids-rich pitch as binder. The removal of Q.I. without the formation of a filter cake, which amounts to a sludge or waste material, is an additional benefit.

While the present invention has been particularly described, in conjunction with specific preferred embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A process for converting an internal stream in a coal tar distillery containing quinoline-insoluble particles (Q.I.), to produce coal tar pitch which comprises: heating Q.I.-containing coal tar to a temperature sufficient to remove therefrom substantially all water to produce a heated dehydrated tar; continuously feeding the heated dehydrated tar into a circulation loop which includes a cross-flow filtration membrane filter and a pump to circulate continuously the heated dehydrated tar to obtain (i) a substantially Q.I.-free permeate stream exiting the circulation loop via said cross-flow filter and (ii) a Q.I.-containing stream; thereafter continuously, and concurrently with the feeding of additional heated dehydrated tar into said circulation loop, releasing a portion of said Q.I.-containing stream from said circulation loop; and thereafter separately fractionating the substantially Q.I.-free permeate stream and the Q.I.-containing stream to separate and remove tar distillate fractions and produce a substantially Q.I.-free coal tar pitch and a separate, Q.I.-containing coal tar pitch.

2. The process of claim 1 wherein the coal tar streams are maintained at elevated temperatures above ambient and all of said steps are continuous.

3. The process of claim 1 wherein the coal tar streams are maintained at elevated temperatures above ambient and at least some of said steps, other than said step of continuously circulating the dehydrated tar to obtain said substantially Q.I.-free permeate stream and said Q.I.-containing stream, are not continuous.

4. The process of claim 1 wherein said dehydrated tar is maintained at a temperature above about 140° C. as it is fed into said circulation loop to obtain said substantially Q.I.-free permeate stream and said Q.I.-containing stream.

5. The process of claim 1 wherein said dehydrated tar is maintained at a pressure above about 40 psig in said circulation loop to obtain said substantially Q.I.-free permeate stream and said Q.I.-containing stream.

6. A process for converting an internal stream in a coal tar distillery containing quinoline-insoluble particles (Q.I.) to produce coal tar pitch which comprises: heating Q.I.-containing coal tar to a temperature sufficient to remove therefrom substantially all water to produce a heated dehydrated tar; fractionating the dehydrated tar to separate and remove tar distillate fractions to produce a soft coal tar pitch; continuously feeding the soft coal tar pitch into a circulation loop which includes a cross-flow filtration membrane filter and a pump to circulate continuously the soft coal tar pitch to obtain (i) a substantially Q.I.-free permeate stream exiting the circulation loop via said cross-flow filter and (ii) a Q.I.-containing stream; thereafter continuously, and concurrently with the feeding of additional soft coal tar pitch into said circulation loop, releasing a portion of said Q.I.-containing stream from said circulation loop; and thereafter separately fractionating the substantially Q.I.-free permeate stream and the Q.I.-containing stream to separate and remove additional tar distillate fractions and produce a substantially Q.I.-free coal tar pitch and a separate, Q.I.-containing coal tar pitch.

7. The process of claim 6 wherein the coal tar streams are maintained at elevated temperatures above ambient and all of said steps are continuous.

8. The process of claim 6 wherein the coal tar streams are maintained at elevated temperatures above ambient and at least some of said steps, other than said step of continuously circulating the soft coal tar pitch to obtain said substantially Q.I.-free permeate stream and said Q.I.-containing stream, are not continuous.

9. The process of claim 6 wherein said soft coal tar pitch is maintained at a temperature above about 250° C. as it is fed into said circulation loop to obtain said substantially Q.I.-free permeate stream and said Q.I.-containing stream.

10. The process of claim 6 wherein said soft coal tar pitch is maintained at a pressure above about 40 psig in said circulation loop to obtain said substantially Q.I.-free permeate stream and said Q.I.-containing stream.

11. A process for converting an internal stream in a coal tar distillery containing quinoline-insoluble particles (Q.I.) to produce coal tar pitch which comprises: heating Q.I.-containing coal tar to a temperature sufficient to remove therefrom substantially all water to produce a heated dehydrated tar; fractionating the dehydrated tar to separate and remove tar distillate fractions to produce a hard coal tar pitch; continuously feeding the hard coal tar pitch into a circulation loop which includes a cross-flow filtration membrane filter and a pump to circulate continuously the hard coal tar pitch to obtain (i) a substantially Q.I.-free pitch exiting the circulation loop via said cross-flow filter and (ii) a Q.I.-containing pitch; thereafter continuously, and concurrently with the feeding of additional hard coal tar pitch into said circulation loop, releasing a portion of said Q.I.-containing pitch from said circulation loop; and thereafter separately cooling the substantially Q.I.-free pitch and the Q.I.-containing pitch to produce a substantially Q.I.-free coal tar pitch and a separate, Q.I.-containing coal tar pitch.

12. The process of claim 11 wherein the coal tar pitches are maintained at elevated temperatures above ambient and all of said steps are continuous.

13. The process of claim 11 wherein the coal tar pitches are maintained at elevated temperatures above ambient and at least some of said steps, other than said step of continuously circulating the hard coal tar pitch to obtain said substantially Q.I.-free permeate pitch and said Q.I.-containing pitch, are not continuous.

14. The process of claim 11 wherein said hard coal tar pitch is maintained at a temperature above about 300° C. as it is fed into said circulation loop to obtain said substantially Q.I.-free permeate pitch and said Q.I.-containing pitch.

15. The process of claim 11 wherein said hard coal tar pitch is maintained at a pressure above about 40 psig in said circulation loop to obtain said substantially Q.I.-free permeate pitch and said Q.I.-containing pitch.

16. A process for converting an internal stream in a coal tar distillery containing quinoline-insoluble particles (Q.I.), to produce coal tar pitch which comprises: heating Q.I.-containing coal tar to a temperature sufficient to remove therefrom substantially all water to produce a heated dehydrated tar; continuously feeding the heated dehydrated tar at a temperature above about 140° C. into a circulation loop which includes a cross-flow filtration membrane filter and a pump to circulate continuously the heated dehydrated tar and maintain said heated dehydrated tar at a pressure above about 40 psig to obtain (i) a substantially Q.I.-free permeate stream exiting the circulation loop via said cross-flow filter and (ii) a Q.I.-containing stream; thereafter continuously, and concurrently with the feeding of additional heated dehydrated tar into said circulation loop, releasing a portion of said Q.I.-containing stream from said circulation loop; and thereafter separately fractionating the substantially Q.I.-free permeate stream and the Q.I.-containing stream to separate and remove tar distillate fractions and produce a substantially Q.I.-free coal tar pitch and a separate, Q.I.-containing coal tar pitch.

17. A process for converting an internal stream in a coal tar distillery containing quinoline-insoluble particles (Q.I.) to produce coal tar pitch which comprises: heating Q.I.-containing coal tar to a temperature sufficient to remove therefrom substantially all water to produce a heated dehydrated tar; fractionating the dehydrated tar to separate and remove tar distillate fractions to produce a soft coal tar pitch; continuously feeding the soft coal tar pitch at a temperature above about 250° C. into a circulation loop which includes a cross-flow filtration membrane filter and a pump to circulate continuously the soft coal tar pitch and maintain said soft coal tar pitch at a pressure above about 40 psig to obtain (i) a substantially Q.I.-free permeate stream exiting the circulation loop via said cross-flow filter and (ii) a Q.I.-containing stream; thereafter continuously, and concurrently with the feeding of additional soft coal tar pitch into said circulation loop, releasing a portion of said Q.I.-containing stream from said circulation loop; and thereafter separately fractionating the substantially Q.I.-free permeate stream and the Q.I.-containing stream to separate and remove additional tar distillate fractions and produce a substantially Q.I.-free coal tar pitch and a separate, Q.I.-containing coal tar pitch.

18. A process for converting an internal stream in a coal tar distillery containing quinoline-insoluble particles (Q.I.) to produce coal tar pitch which comprises: heating Q.I.-containing coal tar to a temperature sufficient to remove therefrom substantially all water to produce a heated dehydrated tar; fractionating the dehydrated tar to separate and remove tar distillate fractions to produce a hard coal tar pitch; continuously feeding the hard coal tar pitch at a temperature above about 300° C. into a circulation loop which includes a cross-flow filtration membrane filter and a pump to circulate continuously the hard coal tar pitch and maintain said hard coal tar pitch at a pressure above 40 psig to obtain (i) a substantially Q.I.-free permeate stream exiting the circulation loop via said cross-flow filter and (ii) a Q.I.-containing stream; thereafter continuously, and concurrently with the feeding off additional hard coal tar pitch into said circulation loop, releasing a portion of said Q.I.-containing stream from said circulation loop; and thereafter separately cooling the substantially Q.I.-free permeate stream and the Q.I.-containing stream to produce a substantially Q.I.-free coal tar pitch and a separate, Q.I.-containing coal tar pitch.

19. A process for converting an internal stream in a coal tar distillery containing quinoline-insoluble particles (Q.I.), to produce coal tar pitch which comprises: heating Q.I.-containing coal tar to a temperature sufficient to remove therefrom substantially all water to produce a heated dehydrated tar; continuously feeding the heated dehydrated tar into a circulation loop which includes a cross-flow filtration membrane filter and a pump to circulate continuously the heated dehydrated tar to obtain (i) a substantially Q.I.-free permeate stream exiting the circulation loop via said cross-flow filter and (ii) a Q.I.-containing stream; thereafter continuously, and concurrently with the feeding of additional heated dehydrated tar into said circulation loop, releasing a portion of said Q.I.-containing stream from said circulation loop; and thereafter separately fractionating the substantially Q.I.-free permeate stream to separate and remove tar distillate fractions and produce a substantially Q.I.-free coal tar pitch.

20. The process of claim 19 wherein the coal tar streams are maintained at elevated temperatures above ambient and all of said steps are continuous.

21. The process of claim 19 wherein the coal tar streams are maintained at elevated temperatures above ambient and at least some of said steps, other than said step of continuously circulating the dehydrated tar to obtain said substantially Q.I.-free permeate stream and said Q.I.-containing stream, are not continuous.

22. The process of claim 19 wherein said dehydrated tar is maintained at a temperature above about 140° C. as it is fed into said circulation loop to obtain said substantially Q.I.-free permeate stream and said Q.I.-containing stream.

23. The process of claim 22 wherein said dehydrated tar is maintained at a pressure above about 40 psig in said circulation loop to obtain said substantially Q.I.-free permeate stream and said Q.I.-containing stream.

24. A process for converting an internal stream in a coal tar distillery containing quinoline-insoluble particles (Q.I.) to produce coal tar pitch which comprises: heating Q.I.-containing coal tar to a temperature sufficient to remove therefrom substantially all water to produce a heated dehydrated tar; fractionating the dehydrated tar to separate and remove tar distillate fractions to produce a soft coal tar pitch; continuously feeding the soft coal tar pitch into a circulation loop which includes a cross-flow filtration membrane filter and a pump to circulate continuously the soft coal tar pitch to obtain (i) a substantially Q.I.-free permeate stream exiting the circulation loop via said cross-flow filter and (ii) a Q.I.-containing stream; thereafter continuously, and concurrently with the feeding of additional soft coal tar pitch into said circulation loop, releasing a portion of said Q.I.-containing stream from said circulation loop; and thereafter separately fractionating the substantially Q.I.-free permeate stream to separate and remove additional tar distillate fractions and produce a substantially Q.I.-free coal tar pitch.

25. The process of claim 24 wherein the coal tar streams are maintained at elevated temperatures above ambient and all of said steps are continuous.

26. The process of claim 24 wherein the coal tar streams are maintained at elevated temperatures above ambient and at least some of said steps, other than said step of continuously circulating the soft coal tar pitch to obtain said substantially Q.I.-free permeate stream and said Q.I.-containing stream, are not continuous.

27. The process of claim 24 wherein said soft coal tar pitch is maintained at a temperature above about 250° C. as it is fed into said circulation loop to obtain said substantially Q.I.-free permeate stream and said Q.I.-containing stream.

28. The process of claim 27 wherein said soft coal tar pitch is maintained at a pressure above about 40 psig in said circulation loop to obtain said substantially Q.I.-free permeate stream and said Q.I.-containing stream.

29. A process for converting an internal stream in a coal tar distillery containing quinoline-insoluble particles (Q.I.) to produce coal tar pitch which comprises: heating Q.I.-containing coal tar to a temperature sufficient to remove therefrom substantially all water to produce a heated dehydrated tar; fractionating the dehydrated tar to separate and remove tar distillate fractions to produce a hard coal tar pitch; continuously feeding the hard coal tar pitch into a circulation loop which includes a cross-flow filtration membrane filter and a pump to circulate continuously the hard coal tar pitch to obtain (I) a substantially Q.I.-free pitch exiting the circulation loop via said cross-flow filter and (ii) a Q.I.-containing pitch; thereafter continuously, and concurrently with the feeding of additional hard coal tar pitch into said circulation loop, releasing a portion of said Q.I.-containing pitch from said circulation loop; and thereafter separately cooling the substantially Q.I.-free permeate pitch to produce a substantially Q.I.-free coal tar pitch.

30. The process of claim 29 wherein the coal tar pitch is maintained at elevated temperature above ambient and all of said steps are continuous.

31. The process of claim 29 wherein the coal tar pitch is maintained at elevated temperature above ambient and at least some of said steps, other than said step of continuously circulating the hard coal tar pitch to obtain said substantially Q.I.-free permeate stream and said Q.I.-containing stream, are not continuous.

32. The process of claim 29 wherein said hard coal tar pitch is maintained at a temperature above about 300° C. as it is fed into said circulation loop to obtain said substantially Q.I.-free permeate pitch and said Q.I.-containing pitch.

33. The process of claim 32 wherein said hard coal tar pitch is maintained at a pressure above about 40 psig in said circulation loop to obtain said substantially Q.I.free permeate pitch and said Q.I.-containing pitch.

34. A process for converting an internal stream in a coal tar distillery containing quinoline-insoluble particles (Q.I.) to produce coal tar pitch which comprises: heating Q.I.-containing coal tar to a temperature sufficient to remove therefrom substantially all water to produce a heated dehydrated tar; fractionating the dehydrated tar to separate and remove tar distillate fractions to produce an internal tar distillation intermediate stream at a processing temperature; continuously feeding the intermediate stream at the intermediate stream processing temperature into a circulation loop which includes a cross-flow filtration membrane filter and a pump to circulate continuously the intermediate stream to obtain (i) a substantially Q.I.-free permeate stream exiting the circulation loop via said cross-flow filter and (ii) a Q.I.-containing stream; thereafter continuously, and concurrently with the feeding of additional intermediate stream into said circulation loop, releasing a portion of said Q.I.-containing stream from said circulation loop; and thereafter separately fractionating the substantially Q.I.-free permeate stream to separate and remove additional tar distillate fractions and produce a substantially Q.I.-free coal tar pitch.

35. A process for converting an internal stream in a coal tar distillery containing quinoline-insoluble particles (Q.I.) to produce coal tar pitch which comprises: heating Q.I.-containing coal tar to a temperature sufficient to remove therefrom substantially all water to produce a heated dehydrated tar; fractionating the dehydrated tar to separate and remove tar distillate fractions to produce a coal tar pitch; continuously feeding the coal tar pitch into a circulation loop which includes a cross-flow filtration membrane filter and a pump to circulate continuously the coal tar pitch to obtain (i) a substantially Q.I.-free coal tar pitch exiting the circulation loop via said cross-flow filter and (ii) a Q.I.-containing pitch; thereafter continuously, and concurrently with the feeding of additional coal tar pitch into said circulation loop, releasing a portion of said Q.I.-containing stream from said circulation loop to produce a substantially Q.I.-free coal tar pitch.

* * * * *